United States Patent [19]

Westerlund

[11] 4,098,671

[45] Jul. 4, 1978

[54] CATHODE FOR ELECTROLYTIC PROCESS INVOLVING HYDROGEN GENERATION

[75] Inventor: H. Benny Westerlund, Squamish, Canada

[73] Assignee: Gow Enterprises Limited, Vancouver, Canada

[21] Appl. No.: 788,499

[22] Filed: Apr. 18, 1977

[51] Int. Cl.[2] ..... C25B 11/03; C25B 11/10

[52] U.S. Cl. ..... 204/284; 204/289; 204/290 F; 204/291

[58] Field of Search ..... 204/284, 289, 290 R, 204/290 F, 291–293

[56] References Cited

U.S. PATENT DOCUMENTS

| | | | |
|---|---|---|---|
| 3,732,157 | 5/1973 | DeWitt | 204/291 X |
| 3,873,437 | 3/1975 | Pulver | 204/284 X |
| 3,919,059 | 11/1975 | Raetzsch et al. | 204/256 X |
| 3,994,798 | 11/1976 | Westerlund | 204/289 X |

*Primary Examiner*—John H. Mack
*Assistant Examiner*—D. R. Valentine
*Attorney, Agent, or Firm*—Millen & White

[57] ABSTRACT

A novel cathode is provided which comprises a porous titanium sheet having a cathodic exposed surface of hydrided titanium, preferably where the core of the sheet is of less porosity or higher density than the surface. The hydrided surface of the cathode may include a coating of silver thereon and therein within the pores, or the hydrided surface of the cathode, either as such or one provided with the silver coating may further include a coating of $MoS_2$ thereon and therein within the pores. Such cathode can be either a monopolar or a bipolar electrode. The core of the cathode is of low porosity to provide improved current transfer and has a surface area of large pore size to enable low cathodic overvoltage.

14 Claims, 6 Drawing Figures

CATHODE FOR ELECTROLYTIC PROCESS INVOLVING HYDROGEN GENERATION

BACKGROUND OF THE INVENTION (i) Field of the Invention

This invention relates to electrodes employed in electrolytic cells of the type used for manufacture of products, e.g., chlorates, perchlorates, persulphates and hydroxides. It relates more specifically to cathodes either alone or as a bipolar electrode including a cathode section and an anode section. The electrode of this invention is utilizable for the production of those products which involve generating hydrogen electrochemically on the surface of the cathode.

(ii) Description of the Prior Art

The cathodes used in early prior art for electrochemical technology were, in most cases, of iron or steel. Later on, graphite was used in many electrolytic cell designs employing bipolar electrodes. In more recent years, since 1965, the cathodes employed commercially have mainly been of steel, combined with anodes fabricated from titanium metal which have been specially surface coated. One multi-electrolytic cell, employing such new anodes combined with steel cathodes, is shown in Canadian Pat. No. 914,610 issued to G. O. Westerland. Another electrolyzer which preferably employs cathodes of steel or other ferrous metal is described in U.S. Pat. No. 3,948,748 issued to Messner et al. Still another, a monopolar type cell, in U.S. Pat. No. 3,598,715 by D. N. Goens, describes a design with cathode assemblies of expanded mild steel. Other cathode materials used in recent technology include the mercury cathode in the electrolytic process of preparing pure hydrogen, in U.S. Pat. No. 3,458,412 issued to Matsuaki Shinagawa et al.

Copending U.S. application Ser. No. 618,078 filed Sept. 30, 1975, now U.S. Pat. No. 3,994,798 provided a teaching of several cathodic materials. Thus, quite generally, that application taught the use of a "suitable cathodic material," which was defined as a material which was electrically conductive, or substantially insoluble in the electrolyte under cathodic conditions, was resistant to reduction, and either was substantially impermeable with respect to $H_2$, or if permeable by $H_2$, was dimensionally stable with respect to $H_2$. Steel was taught to be the preferred material, but it would also be possible to use copper, chromium, cobalt, nickel, lead, tin, iron or alloys of the above metals.

It was, however, also taught that an anode/cathode could be provided from titanium or a titanium alloy. In addition, other metals taught for use as such electrode included tantalum, zirconium and columbium and alloys of such metals. It was taught that, in performing as a cathode, the titanium formed a hydride and consequently some corrosion could occur should the electrolyte temperature be excessive (i.e., above about 100° C.) and equalization of electrical potential in the cell under such circumstances would be poor.

Another anode/cathode taught in that application was one where the anodes employed were of titanium, which was surface coated with platinum to improve anode performance. The cathodes employed were of titanium, which was surface coated or treated to improve their cathode performance as cathode surface by the use of a coating of a "suitable cathodic material" (as heretofore defined). For example, titanium sheet of about 1.5 mm thick having a low carbon steel cathode surface was welded and successfully used as the cathode. The coated electrodes could be made using the explosion bonding technique described in Canadian Pat. No. 760,427 issued June 6, 1967 to Ono et al.

That application also taught the use of a titanium cathode comprising a grit blasted solid sheet, e.g., the use of a grit of aluminum oxide to increase the surface area and a powdered metal porous sheet. However, prolonged use of these cathodes has shown a tendency or erosion and warpage with resulting risk of electrical short circuiting to the adjacent anode.

An improvement thereon was provided in Canadian patent application Ser. No. 232,349 filed July 28, 1975. It was taught that the titanium cathodes could be of the solid sheet, grit blasted type or of the porous or semi-porous fused powdered metal sheet type. Some advantages pointed out for these cathodes were no substantial corrosion; no significant amount of impurities from the cathodes into the electrolyte product; provide for a welded joint for minimum electrical resistance; no cathodic protection hardware required to protect cathodes against corrosion during shut downs; and dimensional stability.

It has been found that while these advantages are true under ideal conditions, nevertheless the cathode is prone to deteriorate drastically in a relatively short period of time, approximately the year's operation, if the conditions are somewhat harsh (i.e., high current density, small spacing, high temperature, high current concentration).

It is also now known that a balancing must be made with respect to pore size. A smaller pore size is desirable for better cathode performance in regard to ohmic resistance. The surface voltage actually is better for the larger pore size. Thus, the cathode should have a small pore size for better conductance of current but a large pore size for improved surface voltage.

It has also been found that, while the cathodes are dimensionally stable if the current distribution is even, in practical application, especially towards the end of an anode life cycle, the current distribution is not uniform over the cathode sheet. This results in warpage which in some cases may be very significant and require a special designed electrode assembly design to prevent electrical short circuiting. Furthermore, in order to re-use the cathode, it may be necessary to heat and press the sheet flat. The powdered titanium cathode, pressed and fused to a porous or semi-porous sheet, is less inclined to warpage since it is likely to be several times the thickness (i.e., in cases where current flows longitudinally through the sheet and voltage drop is maintained the same) compared to the grit blasted titanium sheet cathode.

Moreover, even with solid sheet titanium cathodes there is a tendency to lose thickness after some months' operation due to erosion of the film formed onto the surface of the sheet. This may be very significant after a year of operation.

SUMMARY OF THE INVENTION

Aims of the Invention

The main objects of this invention is to provide an electrode which, when used in the electrolyzer as cathode, provides acceptable current conductance performance, less overvoltage (or at least equal to) than conventional cathodes, dimensional stability over years of operating with little corrosion and by employing titanium as the base metal material, improves welding feasibility, thus minimizing the corrosive action at the joint of the electrodes or to the current connector means.

Statement of Invention

By a broad aspect of the invention, a cathode is provided, comprising a porous titanium sheet having a cathodic exposed surface of hydrided titanium, especially wherein the core of the sheet is of less porosity or higher density than the surface.

Thus according to an aspect of the invention, a cathodic electrode is provided comprising a self-sustaining porous titanium sheet, e.g., powdered titanium which is cast or pressed and sintered into semi-porous or micro-porous form, which is preferably weld integrated with a current transfer means (e.g., an adjacent anode) and treated at elevated temperature in a hydrogen gas atmosphere to provide an exposed cathodic hydrided titanium surface. The core of the cathode is preferably of high density (i.e., low porosity) for improved current transfer with a surface of larger pore size for low cathode overvoltage.

Other Features of the Invention

By one feature the hydrided surface of the cathode includes a coating of silver thereon and therein within the pores.

By another feature the hydrided surface, whether or not it has a coating of silver thereon, includes a coating of $MoS_2$ thereon and therein within the pores.

By provision of a cathode in which basic material is titanium, electrode structures are provided which may be either monopolar and bipolar, respectively. Accordingly in one feature thereof, one face is provided with a coating of an anodic material, thereby providing a front-to-back bipolar electrode. In another feature, an edge of the cathode is provided with a sheet-like extension whose surfaces are provided with an anodic coating thereby providing an end-to-end bipolar electrode.

In a further feature of such end-to-end bipolar electrode a generally U-shaped in cross-section median electrode plate is provided which is formed of titanium or a titanium alloy, interposed between, and connected to, each of the titanium anode extension and the porous titanium cathode, the median electrode extending below the bottom edge of the anode and the cathode, and extending above the top edge of the anode and; a plurality of electrically insulating spacer elements projecting outwardly from both side faces of at least the plate-like metallic cathode.

In yet a further feature, the median electrode comprises an extension of the porous cathode and includes a vertical forwardly protruding ridge, and a corresponding vertical dorsal channel to cooperate with a ridge of an adjacent cathode.

For monopolar electrolyzers, the invention provides a cathode which may be welded if the area proposed for the weld is protected during hydrogen gas absorption to a common titanium carrier plate for current distribtuion or to titanium material current connector or tank.

Still another feature of this invention is the inherent property of high current efficiency with minimum reduction losses; e.g., in the case of electrolytic production of chlorate reduction losses are very high when employing conventional cathodes without the additive of dichromate to the electrolyte. The additive results in a deposit of chromium oxides onto the cathodes, thus resulting in a cathode with improved current efficiency. This invention has shown high current efficiency with no additive to the electrolyte indicating a benefit of employing powdered titanium structure in the specification for the cathode.

GENERALIZED DESCRIPTION OF THE INVENTION

The base material of the cathode is titanium. Titanium is resistant to wear when used in electrolytic cells of chlorate, perchlorate or chlorine/alkali type. Thus, titanium eliminates maintenance requirements, production disruptions, impurities in the electrolyte (suspended as well as dissolved) and does not require capital investment and operating cost of cathodic protection equipment. However, as a cathode, it will absorb hydrogen to form hydrides, which makes it necessary to consider titanium as the base material only.

In a specific case where an anode is one part of the electrode and a cathode is another part of the same electrode, the joint (if any) between such parts should provide low electrical resistance, no significant deterioration with time, and structural strength for handling and use. A welded joint would meet the above specifications, provided it is a performance weld. Since the base material for the anode is titanium, it follows that the base material for the cathode, at least for the fabrication welding phase, should also be titanium material.

In a specific case where the anode is one side of the electrode and the cathode is the other side of the electrode, there is an advantage in employing the same basic material for the anode part as for the cathode part. The anode requires titanium as the base material in the latest developed commercial electrodes; thus, it follows that titanium should be the basic material for the cathode part as well.

The titanium cathodes should be of the solid or screen type or of the powdered sintered type. Special considerations arise because of inherent deficiences in such materials. Solid and screen type structures of titanium show high hydrogen overvoltage resulting in up to 20% increases in the electric power cost of the product compared to using conventional cathodes for the production. Thus, it is not economically feasible to use those structures as cathodes without special treatment, as taught by the present invention. A "grit blasted" surface shows lower overvoltage. Nevertheless, a hydride film will develop on the surface. If eroded off, the result will be a deteriorating performance. For long term performance, an improved cathode is desired.

Powdered (press-sintered) structure has better overvoltage performance than solid or screen type titanium structures. The powdered structure will hydride the same as the solid structures when used as cathodes. The effect is normally not as drastic since due to the lower density these structures would probably have more thickness and rigidity. In time, they will however bow or warp if hydrogen uptake is not evenly over the surface. Loose particles will come off the structure with resulting deteriorating performance. Bowing and warpage can in part be remedied by heat-pressing the structures. This represents an extra cost and does not completely eliminate wear of the cathodes. Powdered structures are very reactive. At elevated temperature, they ignite and react with significant heat generation.

GENERAL DESCRIPTION OF A PREFERRED EMBODIMENT

By this invention an improved structure of powdered (pressed and sintered) titanium is provided which has been treated for improved performance as a cathode and for safety reasons as follows: (a) the electrode of powdered titanium is first ignited in an inert and/or non-oxicizing atmosphere to passify the titanium powder for safety in subsequent handling, work and use; and/or (b) the cathode of powdered titanium is ignited in a partial or total hydrogen gas atmosphere for passification and for hydrogen uptake onto the surface of the structure with less hydride formation in the core of the structure.

A further improved cathode is provided by the step of surface hardening for improved wear rate, i.e., to improve bond in the structure of the titanium powder and partially hydrided titanium powder by coating with silver.

The cathode is still further improved by applying a surface coating for less cathode reduction reaction losses, by employing a molybdenum sulfide ($MoS_2$) sintered surface coating on the powdered titanium structure, preferably simultaneously with the hydriding treatment (b). Such cathode may be still further improved in bonding structure of the titanium powder and partially hydrided titanium powder as well as improved electrical conductivity of surface and structure by coating with silver.

BRIEF DESCRIPTION OF THE DRAWINGS

In the accompanying drawings.

SPECIFIC DESCRIPTION OF PREFERRED EMBODIMENTS

Figure 1:
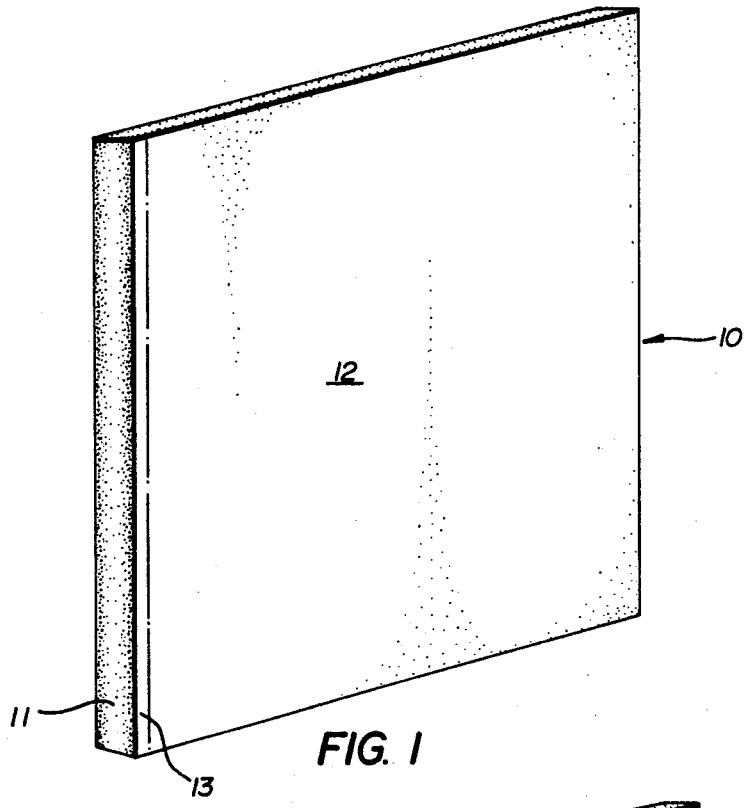
FIG. 1 is a perspective view of a cathode structure of one embodiment of this invention.

Specific Description of FIG. 1

In FIG. 1, the cathode 10 includes a core 11 of less porosity, i.e., of higher density, than the exposed outer surfaces 12 which are of an activated porous titanium nature. The activation may be to provide a hydride surface, either as such or substantially simultaneously coated with molybdenum sulfide, or coated with silver and with molybdenum sulfide. One marginal area 13 of the cathode 10 is protected during the hydrogen gas treatment to provide an unhydrided titanium surface to facilitate enable the welding of the joint.

Figure 2:
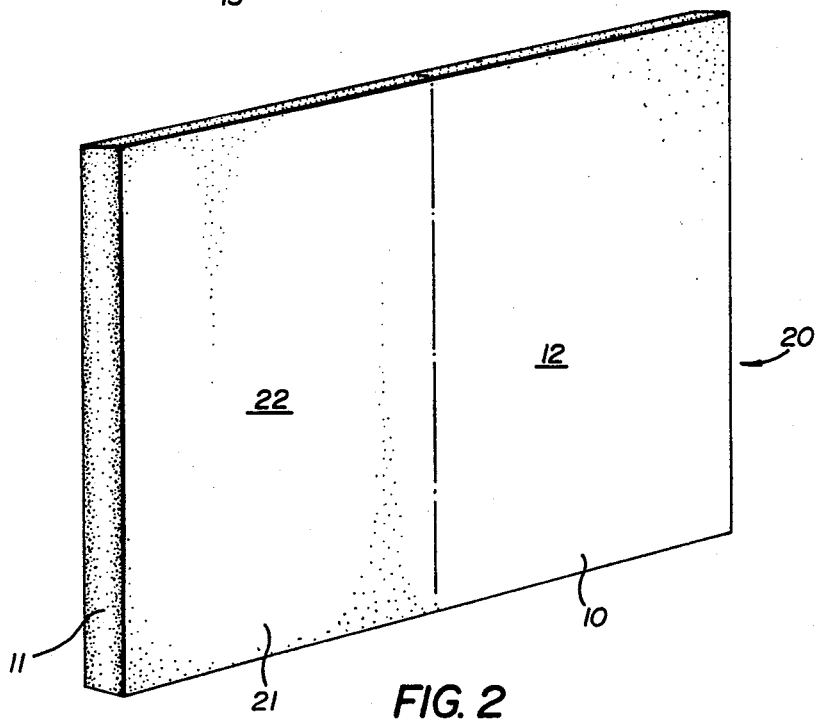
FIG. 2 is a perspective view of an electrode module comprising an integrated anode and cathode structure of an embodiment of this invention.

Specific Description of FIG. 2

In FIG. 2, the electrode 20 includes a cathodic end 10 which is identical with cathode 10 described in relation to FIG. 1 and an anodic end 21. The anodic end 21 has its titanium surface coated, in any manner known to those skilled in the art, to provide an anodic surface 22.

It will be observed that the current flows as shown in the direction of the arrow, i.e., from the cathode 10 longitudinally to the anode 21, and then discharges outwardly from the anode surface 22.

Figure 3:
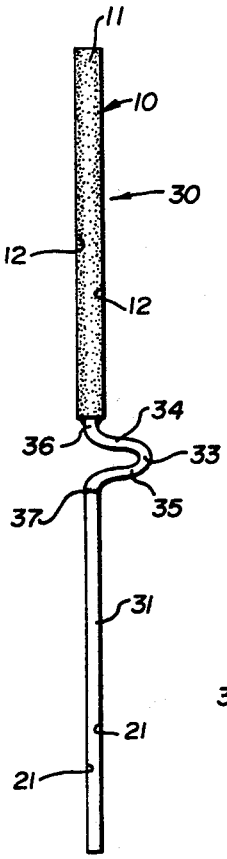
FIG. 3 is a top plan view of an electrode module comprising an anode, a cathode and a median electrode providing cell divider means and the means for the assembly of stocked modules in an electrolyzer, according to another embodiment of this invention.

Specific Description of FIG. 3

As seen in FIG. 3, the electrode 30 includes a cathode 10 which is identical in structure to cathode 10 of FIG. 1 and an anode 31. The bipolar electrode 30 thus includes a generally plate-like metallic anode 31, the hereinbefore described metallic cathode 10 being separated by, and connected to, an upstanding median metallic electrode 33, having a generally "U"-shaped, cross-section, and constituted by a pair of spaced-apart legs 34, 35, each having a lateral wing 36, 37, respectively, extending therefrom, by which the median electrode 33 is connected to the cathode 10 and to the anode 31, respectively. The median electrode 33 is connected to the anode 31 at a butt edge at lateral wing 36, and to the cathode 10 at a butt edge at lateral wing 37. The connection is by means of welding.

While not shown in FIG. 3, the cathode 10 should be equipped with spacer rods. These spacer rods are designed to provide the cell spacing when the electrode is fitted in the cell. A suitable spacer is made of polyvinyl dichloride (PVDC). Other suitable electrically non-conductive plastics materials are those known by the Trade Marks of Kynar, Kel-F or Teflon. The spacer rods may be produced by employing extruded rods which are slightly less in diameter than any holes punched in the cathode 10 with a length cut to yield the desired protrusion on the sheets. If the rods are made of PVDC, the cathode 10 is baked at about 300° C. for about 2 minutes; the PVDC rods swell to form the spacer at the same time as it longitudinally shrinks. If Kynar, Kel-F or Teflon are used, applied pressure is required. Normally the spacer rods protrude from about 1 to 5 mm. The number of spacers depends on the thickness of cathode 10, its flatness and the desired spacing. For example, a 2 mm thick standard steel cathode 10 having a thickness of about 2 mm having a spacing of about 3 mm required approximately 100 mm between the spacer rods. Although it is preferred to apply the spacer rods to the cathodes 10, they may equally well be applied to the anode 31.

An electrode assembly may be provided by the interleaving of the anodes 31 with the cathodes 10, with an interelectrode spacing being defined by the spacer rods and also by the curvatures of the median electrodes 33 which are in front face-to-rear face contact.

Figure 4:
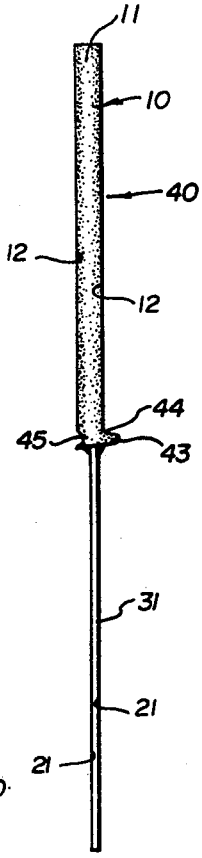
FIG. 4 is a top plan view of an electrode module comprising an anode, a cathode and a median electrode providing cell divider means and the means for the assembly of stocked modules in an electrolyzer, according to yet another embodiment of this invention.

Specific Description of FIG. 4

FIG. 4 shows a modification of the bipolar electrode of FIG. 3. As seen in FIG. 4, the bipolar electrode 40 includes a cathodic element 10, identical to cathodic element 10 of FIG. 3, and an anodic element 31 identical to anodic element 31 of FIG. 3. However, the median electrode 43 is formed of the cathodic material in the form of a forward vertical protruding ridge 44 and a dorsal vertical cooperating channel 45. Spacer rods, such as described above for FIG. 3 are also provided. When the electrode 40 is stacked in use in an electrolyzer, ridge 44 cooperates with channel 45.

Figure 5:
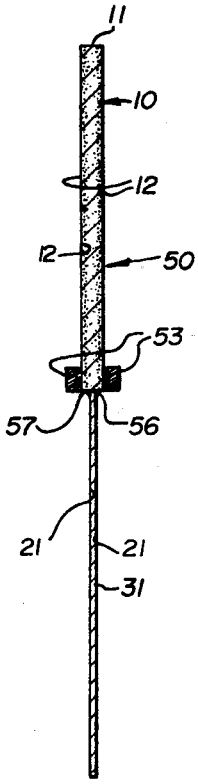
FIG. 5 is a top plan view of an electrode module comprising an anode, a cathode and a median electrode providing cell divider means and the means for the assembly of stocked modules in an electrolyzer, according to an embodiment of this invention.

Specific Description of FIG. 5

FIG. 5 shows a further modification of the bipolar electrode of FIG. 3. As seen in FIG. 5, the bipolar electrode 50 includes a cathodic element 10, identical to cathodic element 10 of FIG. 3, and an anodic element 31, identical to anodic element 31 of FIG. 3. Anodic element 31 is butt welded, at 56, to edge 57 of cathodic element 10. Instead of a median electrode, however, a divider strip 53 is provided on each face 12 of the cathodic element 10.

Divider strip 53 is formed of any suitable electrically non-conductive plastics material as described in FIG. 3, e.g., PV DC, Hynar, Kel-F, or Teflon. Such divider strips provide, firstly, a division between the cathode 10 and the anode 31 when the bipolar electrode 50 is assembled in an electrolyzer. This controls any current leakage between the cells. The strip is thus used as a non-conductive stopper when the electrodes are stacked in the electrolzyer.

The divider strips 53 also assure that the end 57 which is welded to the anode 31, has an anodic potential when used. The weld thus does not hydride and there are no significant problems in rewelding a new anode should this be desirable.

Figure 6:
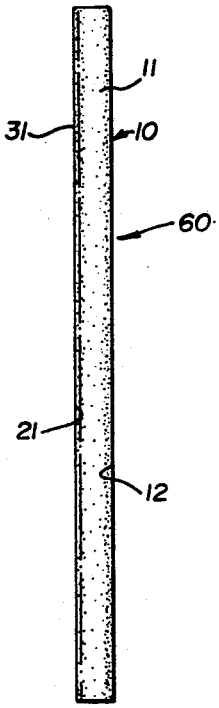
FIG. 6 is a top plan view of a bipolar electrode with one side being the anode, and the other side comprising the main part of material section depth being the cathode of still another embodiment of this invention.

Specific Description of FIG. 6

FIG. 6 shows a bipolar electrode based on the structure of FIG. 1, namely a front-to-back bipolar electrode 60. The cathodic "front" 10 is identical in structure to the cathode 10 described hereinbefore. The anode 31 is identical in structure to the anode 31 described hereinbefore. However, it is noted that the working active cathode 10 has a depth greater than the uncoated anode surface. In most cases, more than 90 percent of the thickness of the electrode 60 is the cathode 10.

The current flow is through the thickness of the cell from the cathode 10 to the anode 31. Thus it is not necessary to provide a higher density core. In fact, if the porosity is substantially constant the electrolyte could be formed to flow through the pores of the electrode.

Test Results on the Cathode

Abrasion Resistance

Velocity 40 feet/second of water at near boiling temperature (5 mm thick cathode)

50 micron titanium powder press-sintered basic structure: (data approx. only)

40% hydrided — 10 minutes above 900° C. = 50,000 mg/day and $m^2$

40% hydrided — ½ minute above 900° C. = 500

10% hydrided — 10 minutes above 900° C. =( not significantly different to (

10% hydrided — ½ minute above 900° C. =(40% hydride)

Hydrided + $MoS_2$* Sintered (* 100 gm/$m^2$) = 100

Hydrided + Ag Coated ( 20 gm/$m^2$) = 50

Hydrided + $MoS_2$* Sintered + Ag ** Coated = Trace only

It is noted that the tensile strength is drastically reduced for structures treated for 10 minutes compared to ½ minutes. It is improved by $MoS_2$ and/or Ag coating. Electrical conductivity is also very significantly decreased by prolonged heat treatment.

Bowing

Brine and caustic electrolyte, respectively, current density range 1000 to 3000 amperes/square meter, temperature 65° to 95° C., electrode spacing 3 mm:

Comparing untreated powdered titanium structures of 3, 5 and 8 mm thickness showing approximately 3 mm bowing for 300 mm length of cathode after 3 months:

5% hydrided — 90% improvement

40% hydrided — 100% improvement(i.e. no

10% hydrided + $MoS_2$ sintered — 100% improvement (apparent

10% hydrided + $MoS_2$ sintered + Ag coated — 100% improvement (bowing)

Hydrogen Overvoltage

Powdered titanium structure with 10% hydrogen takeup showed about the same hydrogen overvoltage as a mild steel cathode. A structure with 40% hydrogen takeup showed about 0.1 to 0.3 volt higher.

With silver coating onto the structure of 10% hydrogen takeup, the overvoltage did not significantly improve. However, applying silver coating on the structure with molybdenum sulfide sintered surface indicated approximately 0.1 volt improvement.

Reduction Losses

The yield of hydrogen in a brine electrolyte containing about 1 gpl sodium hypochlorite and no dichromate was approximately 96% with $MoS_2$ sintered coating, less than 93% without $MoS_2$ and only a slight improvement with Ag coating.

(h) Examples (i) Comparing cathodes in brine and caustic electrolyte, respectively Current density range — 1000 to 3000 amperes/square meter Anode to cathode spacing — 3 millimeter Temperature of electrolyte — 60 to 95° C.

Using the same anode (titanium base surface coated with platinum), the cell voltages did not differ for the hydrogen gas treated cathode compared to untreated cathode and were equal to steel cathode or better; the "better" results were for cathodes with 300 mm or less longitudinal length and cross-sectional thickness of more than 3 mm. The treated electrode did not bow over several months operating with one side only being active cathode, neither was any wear rate or change in physical strength detected. The untreated cathodes (porous powdered titanium, 3, 5 and 8 mm thick, respectively) showed about 3 mm (slightly more for the 3 mm thick compared to 5 and 8 mm) bowing over 300 mm length for both brine and caustic electrolyte; the surface was also slightly rougher, indicating possible erosion of powder. By comparison a solid titanium sheet cathode (untreated) did bow from 5 mm up to 20 mm at higher current density and showed erosion wear.

(ii) Electrical resistance of electrodes and voltage performance; powdered titanium metal electrode of up to 75% porosity and 50 micron powder showed lowest voltage when used as bipolar electrode (as shown in FIG. 5); about 0.2 volt lower compared to a 3 micron, 20% porosity plate.

In an electrode type as shown in FIG. 2, the electrical resistance for longitudinal current flow is significant and using a core of higher density material improves the cell voltage, e.g., a 8 mm thick titanium powder plate 600 mm long (50% length for anode, 50% length for cathode), with a 2 mm thick central core of 3 micron powder of 20% porosity and 3 mm thick each side of core of 50 micron powder with 75% porosity improved the cell voltage by 10% on the basis of a current load for an average current density on the active surface in the cell of 2000 amps per square meter.

The advantage of not hydriding a margin (as shown in FIG. 1) to facilitate a welded joint to the current connector or integrated electrode with the anode was shown by the difference in voltage drop compared to a bolted joint or clamp fit. The millivolt drop under the above current load condition was 10 compared to 20 and experienced deteriorating conditions for the non-welded joint (i.e., increased voltage drop with time).

(iii) Multicell assembly electrode modules

The cathode, of the type shown in FIGS. 3 and 4 and hydrogen gas treated, performed satisfactorily with or without the dividing means. This means provides for easier stacking of modules in the electrolyzer and makes rewelding possible if the anodes are to be sheared off for recoating.

(iv) Chlorate cell performance

When using cathodes of titanium powder sintered metal, 3 to 50 micron and 20 to 75% porosity, the cathode current efficiency for when higher than 1000 amperes/square meter current density and temperature of brine electrolyte in the range of 40° to 100° C. with no dichromate additive was above 95%. By comparison, using steel or graphite cathodes the reduction loss at the cathode was as high as 15 to 20%.

(v) Hydrogen gas treatment

The reaction of hydrogen to powder titanium is relatively slow, at temperatures below 600° C. Even when retained for more than 1 hour, less than 1% of the titanium is hydrided. At 700° C., the reaction is faster, but it is desirable to bring the temperature in the range of 800° to 1300° C. to achieve fast reaction. The reaction is almost instantaneous when the powdered titanium glows red in colour which occurs above 800° C. Even at the high temperature range, less than 50% of the titanium is hydrided but this appears to be sufficient to achieve the desirable effect when used as a cathode. The hydrogen gas treatment seems to work equally well if the gas if heated and allowed to react with a cold powdered titanium proposed cathode assuming sufficient heat is put to the gas to raise the temperature of the cathode until it is high enough to result in the glow compared to heating the titanium by electrical resistance and starting with cold hydrogen gas atmosphere but heating until the proposed cathode glows.

There are no apparent significant dimensional changes in the electrode after treatment. (If heated in an air atmosphere to the "glow state," the oxidation is rapid and will distort the plate as well as make it extremely brittle. The gas absorption also takes place over a water bath, i.e., part of the electrode may be immersed in the water, thus avoiding hydriding.

(vi) Fabrication of cathodes

Powdered titanium structures are commercially available. Such structures which are preferred include a core of dense micro size powder for improved overvoltage.

The structure is ignited to passify the powder. This can be done, e.g., in an argon gas atmosphere if part of the structure is to be used as an anode; otherwise, ignite in hydrogen gas or water vapour with hydrogen. The water vapour slows down hydrogen takeup; silver also inhibits takeup. If $MoS_2$ sintered coating is required, the above ignition process may be combined with sintering of $MoS_2$; the temperature in this case must be above 1200° C. but all heat treatment above 900° C. should preferably be less than 1 minute. $MoS_2$ powder is simply rubbed into the structure. It melts and forms a film at approximately 1185° C. but it is desired to have it sintered rather than a film.

Silver coating is best applied as a secondary treatment, e.g., by means of a paint and heat treatment. Alternatively, a water solution of silver nitrate (or melt at 212° C.) can be applied, heated (450° C.), and decomposed to a silver coating. In decomposing silver nitrate, $NO_2$ is released first and then oxygen, which could violently react with titanium if not properly released.

With prolonged heat treatment, the titanium powder goes soft (similar to carbon in appearance and feeling). The structure is brittle and loses tensile strength. Consequently, igniting and maintaining the heat input and generation for less than one minute at the high temperature is necessary if the best result is to be achieved from electrical conductance, strength and hardness point of view. An overheated structure is usually black all the way through; a structure exposed to high temperature for a few seconds only still has the centre core essentially metallic in appearance. It does not seem to be related to the amount of hydrogen takeup but to the length of high temperature duration. It is difficult to define because it would vary with thickness of structure, porosity, and, e.g., moisture content of the structure and the composition of the gas.

$MoS_2$ would wash off if the temperature has been below sintering. It appears to sinter-coat surface only and make the surface significantly harder.

The silver coating is in depth, i.e., it soaks into the pores if applied as a liquid. It surface coats the titanium powder to a light color and improves bond (and hardness) for the structure. If applied before $MOS_2$, it does not appear to give any other significant benefit than somewhat improved electrical conductity, i.e., not worthwhile pretreatment considering cost.

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

The embodiments of the invention in which an exclusive property or privilege is claimed are defined as follows:

1. A cathode comprising:

(a) a microporous titanium sheet having a central core and surfaces, the pores in the central core being of greater diameter than the pores at the surfaces thereby providing a central core of less porosity than the surfaces; and (b) one exposed surface thereof being microporous hydrided titanium, the hydrided titanium having pores of greater diameter than those of the porous titanium sheet and thus being more porous than the surface of the porous titanium sheet on which it is provided.

2. The cathode of claim 1 wherein the hydrided surface includes a coating of silver thereon and therein within the pores.

3. The cathode of claim 1 wherein the hydrided surface includes a coating of $MoS_2$ thereon and therein within the pores.

4. The cathode of claim 2 wherein the hydrided surface includes a coating of $MoS_2$ thereon and therein within the pores.

5. The cathode of claim 1 wherein one face is provided with a coating of an anodic material, thereby providing a front-to-back bipolar electrode.

6. The cathode of claim 1 wherein an edge thereof is provided with a sheet-like extension whose surfaces are provided with an anodic coating thereby providing an end-to-end bipolar electrode.

7. The cathode of claim 6 including a generally U-shaped in cross-section median electrode plate formed of titanium or a titanium alloy, interposed between, and connected to, each of the titanium anode extension and the porous titanium cathode, the median electrode extending below the bottom edge of the anode and the cathode, and extending above the top edge of the anode and; a plurality of electrically insulating spacer elements projecting outwardly from both side faces of at least the plate-like metallic cathode.

8. The cathode of claim 7 wherein the median electrode comprises an extension of the porous cathode and includes a vertical forwardly protruding ridge, and a corresponding vertical dorsal channel to cooperate with a ridge of an adjacent cathode.

9. The cathode of claim 6 wherein the sheet-like extension is a separate anodic element butt welded to an end of the cathodic element, and wherein each face of the cathodic element adjacent said weld joint is provided with an electrically non-conductive plastic material divider strip.

10. A cathode according to claim 1, wherein the core is sintered micro size powder.

11. A cathode comprising a porous titanium sheet having a cathodic surface wherein the hydrided surface includes a coating of $MoS_2$ thereon and within the pores.

12. A cathode according to claim 11, wherein the hydrided surface includes a coating of silver thereon and within the pores.

13. A cathode material comprising a sintered microporous titanium sheet having a central core and two sides, the central core formed from smaller size titanium powder than the two sides and having a lower porosity than the two sides.

14. A cathode material according to claim 13, wherein the central core has a porosity of 20% and the two sides have a porosity of 75%.

* * * * *